United States Patent [19]

McNerney

[11] Patent Number: 4,760,983

[45] Date of Patent: Aug. 2, 1988

[54] SUPPORT STRUCTURE FOR DIFFERENT TYPES OF BAGS

[75] Inventor: Francis B. McNerney, Ontario, Canada

[73] Assignee: Extrufix Inc., Ontario, Canada

[21] Appl. No.: 923,736

[22] Filed: Oct. 28, 1986

[30] Foreign Application Priority Data

Dec. 13, 1985 [CA] Canada ..... 497694

[51] Int. Cl.[4] ..... B65B 67/12

[52] U.S. Cl. ..... 248/100; 53/390; 220/404; 383/10

[58] Field of Search ..... 248/95, 99, 100, 101, 248/97, 98; 220/403, 404; 383/8, 10; 312/211; 53/390

[56] References Cited

U.S. PATENT DOCUMENTS

| | | | |
|---|---|---|---|
| 2,759,648 | 8/1956 | Piazze . | |
| 2,942,823 | 6/1960 | Chapman . | |
| 3,313,504 | 4/1967 | Stoltze . | |
| 3,360,901 | 1/1968 | Gallo . | |
| 3,481,112 | 12/1969 | Bourgeois . | |
| 3,861,125 | 1/1975 | Hagemeister . | |
| 4,196,880 | 4/1980 | Hynes | 248/95 X |
| 4,322,048 | 3/1982 | Vollman | 248/97 |
| 4,445,658 | 5/1984 | Ferron | 248/99 |
| 4,458,867 | 7/1984 | Malik | 248/99 X |

FOREIGN PATENT DOCUMENTS

| | | |
|---|---|---|
| 23877 | 3/1886 | Canada . |
| 305625 | 2/1969 | Sweden . |

*Primary Examiner*—David L. Talbott

*Attorney, Agent, or Firm*—James W. Hellwege

[57] ABSTRACT

This invention provides a supporting structure for supporting two different types of flexible containers or bags. The structure is capable of supporting open mouth type bags, and in addition, can support handle type bags. Embodiments are disclosed for supporting of both side type handle bags as well as bags provided with handles in the front and rear. The supporting structure for flexible containers comprises retaining means for retaining the open mouth of a flexible container open under tension; means for restraining lateral movement of a container mounted in the device, the means for restraining lateral movement comprising a pair of spaced apart, opposed restraining members extending below the retaining means; opposed engaging means for releasably engaging and retaining a handle of a handle bag; bag bottom supporting means for supporting a bottom of the flexible container; and means for mounting the supporting apparatus.

11 Claims, 6 Drawing Sheets

SUPPORT STRUCTURE FOR DIFFERENT TYPES OF BAGS

This invention relates to a supporting structure for flexible containers.

More particularly, this invention relates to a supporting frame for retaining refuse bags in an upright and open position.

Conventionally, containers for holding refuse bags have included a closed-in or four-sided rigid structure with a top or lid covering a refuse bag held therein. In addition, such conventional containers usually included a closed bottom for supporting the refuse-containing bag.

However, such containers have been found not to be well suited for certain convenient locations in, for example, a user's kitchen, mainly in view of the cumbersome nature of such containers. Thus, for instance, such containers are not easily located inside a kitchen cupboard as they take up a relatively large amount of cupboard space, or interfere with the cupboard door closing.

Another type of container for refuse bags has been proposed in Canadian patent No. 1,010,007, issued May 10, 1977. In this reference, an open-type frame structure is provided which retains a refuse bag in an open condition, which supports the bottom of the refuse bag, and yet which is easily mountable inside a cupboard, not requiring as much space as the above-noted four-sided rigid containers.

It will be noted from Canadian Patent No. 1,010,007 that the device of that reference is particularly suited for dispensing a specific type of refuse bags, usually from a roll of the same. To this end, the device has a roll-dispensing or supporting arrangement provided at the bottom thereof, from which one bag at a time may be drawn up and over the top frame so as to retain the mouth of the bag in an open condition. After the bag in use is filled, it is merely removed from the supporting frame and another bag, supplied from a continuous roll, is arranged in the supporting structure.

The type of bag structure utilized with the device of Canadian Patent No. 1,010,007 is an open mouth flexible bag, usually with front and rear walls, these walls either being joined along the side edges and bottom, or having been formed from a tube of film whereby only the bottom is sealed. This type of bag is not provided with any means for carry the bag such as handles at the top of the bag. As used herein, the above type of bag will be hereinafter referred to as "open-mouth bags", meaning bags such as are generally shown in Canadian No. 1,010,007, and specifically, open mouth bags having no handles. It will be appreciated that such bags need not necessarily be provided in continuous roll form. As an alternative to the roll of bags shown in Canadian No. 1,010,007, such bags may also be provided, for instance, in a zig-zag configuration, whereby the bags are in the form of a continuous supply folded in a zig-zag manner.

With the support structure of the prior art, the open mouth bag is folded over the top ring structure. The ring structure is somewhat spring-loaded for easy positioning of the bag, and by virtue of the spring-loaded feature, the bag fits tightly around the top ring structure and is supported thereby.

One of the disadvantages with the support structure of Canadian No. 1,010,007 is that one must purchase a continuous roll of bags for use therewith, or at the very least, bags of a predetermined size and structure must be utilized with the device. That is, the bag utilized with the support structure must be of a predetermined size around the open mouth portion thereof, so that it will tightly fit around the top ring so that when the bag is filled or partially filled, it will not merely fall through the frame. As such, the tight fit of the open mouth of the bag around the top ring structure is an important feature in order for the device to be used properly.

Thus, certain types of bags which are otherwise readily available to, or used by, consumers, such as plastic handle bags, cannot normally be used with the prior art structure, in view of the fact that the mouth of such bags are usually too large to obtain a tight fitting relationship with the top ring of the support structure.

There are several types of handle type flexible bags available today. Included in handle type bags, for instance, are open mouth bags which have a pair of carrying handles either at the opposed lateral sides of the bag, or at the front and back of the bag. As used herein, the term "handle bags" will refer to either of the above-noted type of bags—i.e., bags with carrying means or handles either on the lateral sides or on the front and rear of the bag.

It would therefore be advantageous if a structure which could support both the above open mouth type refuse bags, as well as handle bags, could be provided. Such a structure would obviously have economical advantages in that bags obtained by the consumer in their day-to-day shopping, could then be put to some useful purpose.

Not only do economical advantages accrue, but also, the ability to use handle bags as refuse containers provide much more convenience to the ordinary consumer, as most households typically have plastic handle bags since these are provided with many of the purchases made by a consumer. Thus, it is not necessary to ensure an abundant supply of refuse containers in roll form is available at all times within one's household.

Many consumers already utilize such handle-bags as containers for refuse, but, as will be appreciated, without some type of supporting structure, or a suitably dimensioned container, such refuse containing bags are very inconvenient and generally untidy and unsightly.

The present invention is directed to an improvement in the open-frame type of supporting structure discussed above.

With the present invention, a supporting structure is provided which may be utilized both for open mouth refuse-containing bags, and for handle bags, such as the type generally supplied to consumers by, e.g., grocery stores and as generally discussed above.

In accordance with one embodiment of the present invention, there is provided a supporting structure for flexible containers comprising:

retaining means for retaining the open mouth of a flexible container open under tension;

means for restraining lateral movement of a container mounted in said device, said means for restraining lateral movement comprising a pair of spaced apart, opposed restraining members extending below said retaining means;

opposed engaging means for releasably engaging and retaining a handle of a handle bag;

bag bottom supporting means for supporting a bottom of said flexible container;

and means for mounting said supporting apparatus.

In one embodiment of the present invention, the opposed engaging means for releasably engaging and retaining a handle of a handle bag may be provided on each of the opposed restraining members. Such a form of the engaging means is particularly useful for holding and retaining refuse containers or bags of the side handle type. Such a type of bag is illustrated typically by Canadian Patent No. 734,800. As used herein, when referring to bags of the side handle type, this means bags which have opposed carrying handles disposed on the lateral sides of the bags.

In a preferred embodiment of the present invention, the above engaging means provided on each of the opposed restraining members may be in the form of a loop extending frontwardly of the structure, and in particularly preferred forms, is in the form of an S-shaped loop. Of course, the loop-shaped engaging means may also be turned 90° or 180° so that the loops could extend laterally outwardly or rearwardly of the structure.

In another form of the present invention, the engaging means for releasably engaging and retaining a handle of a handle bag may be provided generally at the upper portion of the structure, for instance, U-shaped loops may be provided extending downwardly from the retaining means, one at the front and one at the rear of the structure. Alternatively, the U-shaped loop provided on the front of the structure could extend downwardly from the retaining means, while the rear U-shaped loop could extend downwardly from a transversely extending member positioned below the retaining means. These types of structure are particularly suitable for bags which have a front and rear type handle structure as opposed to side type handle bags. The handles of such bags are generally formed by merely punching out a portion of the bag, and thus, the resultant handles do not usually have any great length. Yet, with the device of the present invention, and in this particular form, such bags may still be utilized as refuse containers. As used herein, when referring to bags of the front and rear handle type, this will mean bags which have opposed carrying handles disposed on the front and rear of the bags.

The device of the present invention can be made from various types of materials and in various forms. Preferably, the device is made out of metal wire, or suitable plastic rod. In the case of forming the device from metal wire, the same may be coated with a plastic material. Bars or strips can also be used to form the structure, being suitably welded/joined where appropriate. In manufacturing the device, the structure may be merely stamped from appropriate sheet material or in the case of wire rods, formed on wire-forming machines.

Different sizes of the device may be constructed according to conventional practices to accommodate different sizes of bags.

In the structure of the present invention, the retaining means which functions to mount open mouth bags is preferably partially flexible so as to permit a mouth of a bag to be stretched across the retaining means and maintain the open mouth under tension. Thus, the retaining means may be resilient due to the provision of a U-shaped engaging means in the retaining means for the other type of bag—i.e., the handle bags, so that a user may compress the retaining means slightly to mount the mouth of the bag thereabouts and when mounted, due to the nature of the resilient material, to stretch the mouth of the bag.

Having thus generally described the invention, reference will now be made to the accompanying drawings, illustrating preferred embodiments of the invention, and in which.

Figure 1:
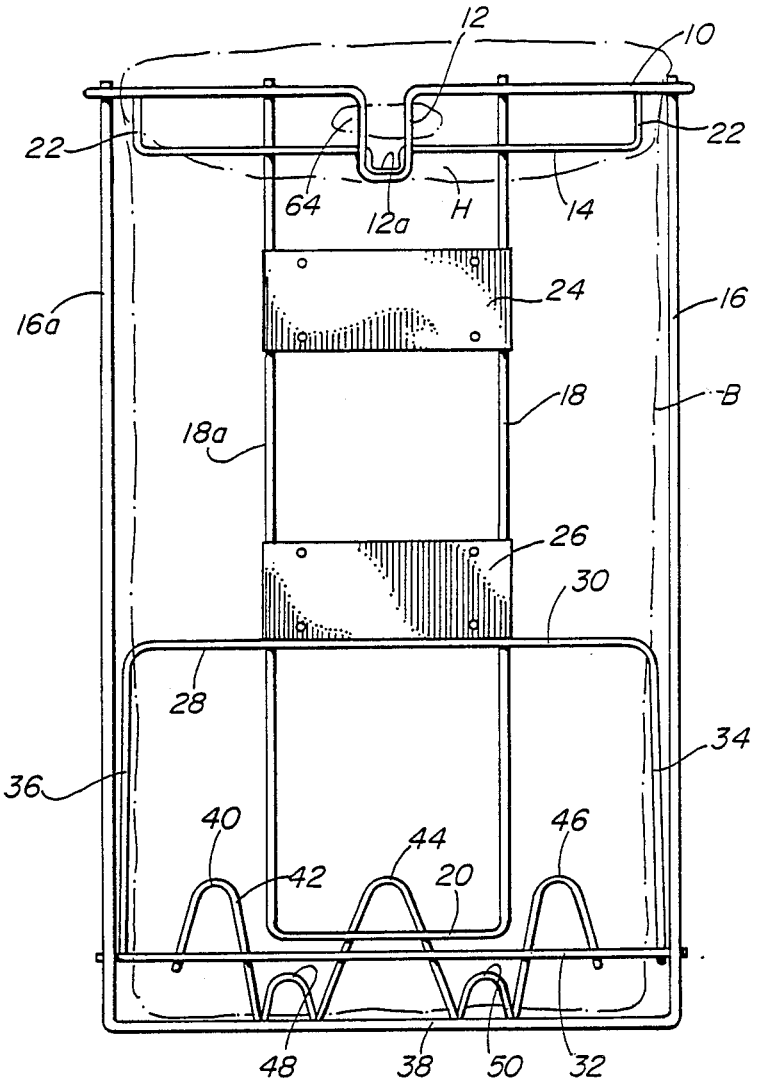
FIG. 1 is a front elevational view of one embodiment of the present invention.

Referring now in greater detail to the drawings, the support structure of the present invention, in one embodiment thereof, illustrated from the front, is shown in FIG. 1. As will be noted from FIG. 1, the support structure is generally of an open frame type configuration and has retaining means 10 comprising an upper horizontal ring-shaped frame member of a continuous nature. Retaining means 10 includes handle engaging means 12 positioned generally centrally of retaining means 10 and being of a generally U-shaped configuration. In the illustrated embodiment, the handle engaging means 12*a*, as will be noted, extends downwardly from horizontally extending rear cross member 14, and is suitably dimensioned to extend downwardly approximately the same distance as handle engaging means 12. It will be appreciated, however, that handle engaging means 12*a* could extend downwardly from the rear portion of retaining means 10 in accordance with the manner shown relative to handle engaging means 12 on the front portion of retaining means 10.

Cross member 14, as will be seen from FIG. 1 has upwardly and outwardly extending lateral free end portions 22. Free end portions 22 may be used as hinge or pivot points if it is desired to include a lid or top over the support structure. In such a case, the lid (not shown) would be provided with appropriate apertures for insertion of the free end portions 22 so that the lid would pivotably move between open and closed positions.

Extending vertically adjacent each side of retaining means 10, lateral bag restraining means 16, 16*a* are provided. A pair of vertically extending frame members 18, 18*a* extend from retaining means 10 at the rear of the retaining means. Rear frame members 18 and 18*a* are joined proximate the bottom of the structure via horizontally extending intermediate portion 20.

Mounting means such as rear plates 24, 26 may be provided extending between rear frame members 18, 18*a* for mounting of the structure onto a substrate surface, such as a wall or cupboard door.

It will be appreciated, the structure could be a free-standing one rather than having mounting means for mounting on a cupboard door. In such an embodiment, the side members 34 and 36 could extend downwardly (and possibly outwardly) to a level similar to that of frame member 38 (described hereinafter) to provide a base for a free-standing structure. Alternatively, the frame member 38 could be extended frontwardly to provide a free-standing structure.

Frame member 28, formed by horizontally extending members 30 and 32 and side members 34 and 36 provides additional bag supporting and restraining means. As seen from FIG. 1, horizontally extending bottom member 32 is of a length slightly greater than the upper horizontally extending member 30. As such, bottom horizontally extending member 32 is suitably attached at either end thereof to each of the lateral bag restraining means 16 and 16*a*. At the upper portion of frame member 28, horizontally extending member 30 may be attached by suitable means to rear frame members 18 and 18*a*. In addition, vertically extending restraining means 16, 16*a* are joined together proximate the bottom of the structure via horizontal frame member 38. Frame member 38 may also extend frontwardly of its rearward position as illustrated, in order to provide an alternative structure for permitting the support structure to be free-standing. Further bag supporting means such as indicated by reference numeral 40, in a snake-like configuration, may also be provided. In the illustrated embodiment, member 40 comprises three front loops 42, 44 and 46 extending from member 32 towards the front of the structure. In addition, rearwardly extending loops 48 and 50 are also provided for supporting a roll of bags, or the like, if desired. Bag supporting means 40 may be suitably connected to the structure along frame member 32.

Figure 2:
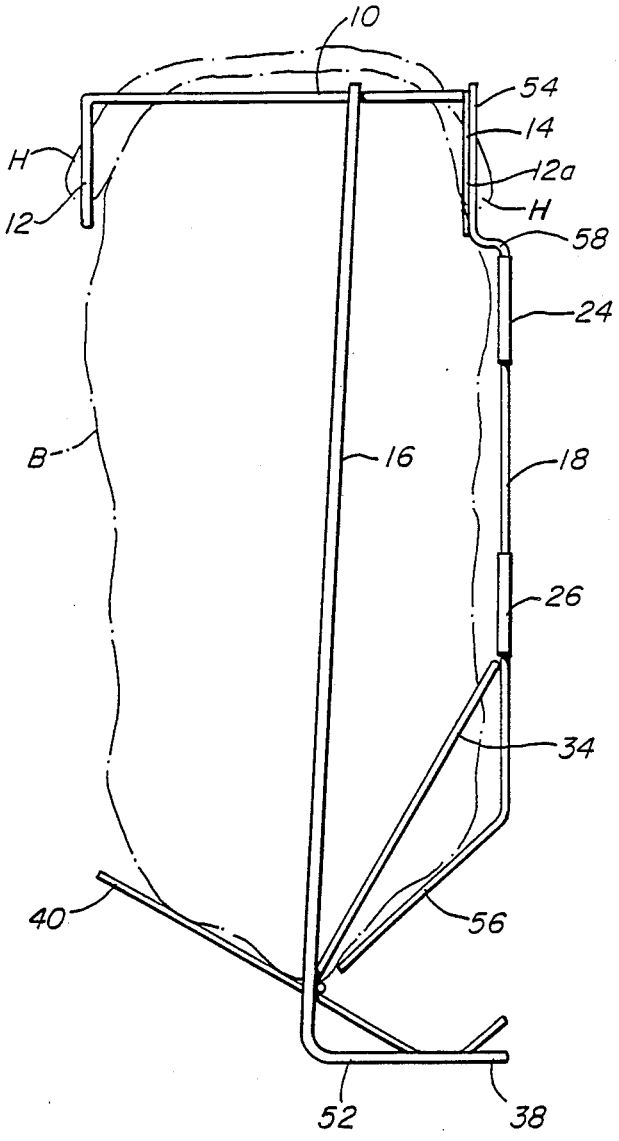
FIG. 2 is a side elevational view of the FIG. 1 embodiment.

Referring now to FIG. 2, it will be noted that lateral bag restraining means 16 is of an elongated rod-like configuration extending from the retaining means 10 and terminating in an L-shaped portion 52 extending rearwardly of the structure. As such, the lateral bag restraining means 16 and 16*a* may be formed of a one-piece rod-like member, suitably formed to the desired L-shaped configuration so that bag restraining means 16 extends downwardly from the retaining means 10 into the L-shaped portion 52, and then upwardly on the other lateral side of the structure to form bag restraining means 16*a*.

As will further be seen from FIG. 2, vertically extending frame member 18, also of a rod-like configuration at the rear of retaining means 10, extends downwardly from the retaining means 10 and in the illustrated embodiment, has an upper portion 54 which is generally in longitudinal alignment with the retaining means 10. As frame member 18 extends downwardly, it will be noted that the central portion thereof extends outwardly from upper portion 54 forming shoulder 58 so that the central portion of frame member 18 is not in longitudinal alignment with the retaining means 10, but rather, extends rearwardly outwardly therefrom. The lower portion 56 of frame member 18 is then angled toward the front of the structure. In a manner similar to lateral bag restraining means 16 and 16*a*, frame members 18 and 18*a* may thus be formed of a one-piece integral rod-like member, suitably formed to shape—that is, frame member 18 extends downwardly from retaining means 10 to terminate in horizontally extending intermediate portion 20 (FIG. 1), and then upwardly towards retaining means 10, to form the frame members 18*a*. As illustrated in FIG. 2, side member 34 of frame member 28 is angled towards the front of the structure.

Figure 3:
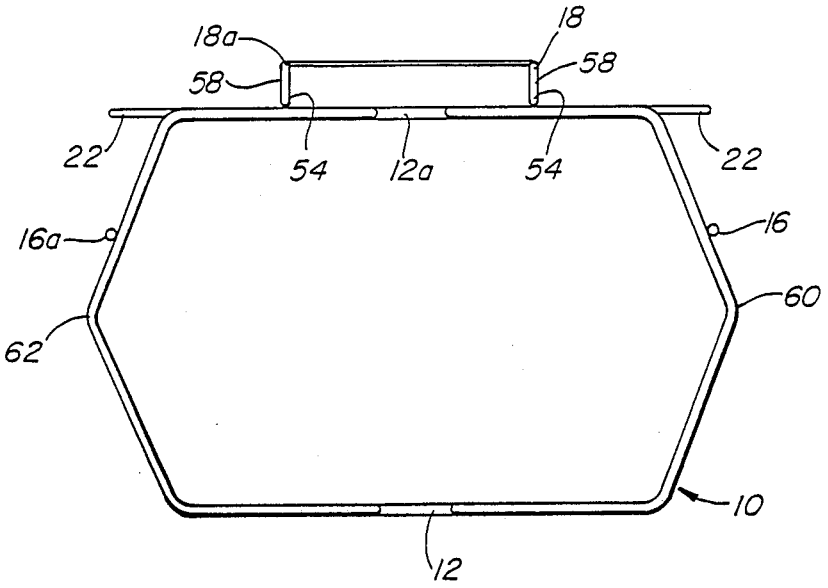
FIG. 3 is a top plan view of the FIG. 1 embodiment.

Referring now to FIG. 3, this illustrates a preferred form of the configuration of the retaining means 10. As will be seen from FIG. 10, the retaining means 10 is in the form of a rod-like hexagonally-shaped member. In a preferred form, the lateral restraining means 16 and 16*a* are mounted around the outer perimeter of the retaining means 10, rearwardly of corners 60 and 62 shown in FIG. 3.

Figure 4:
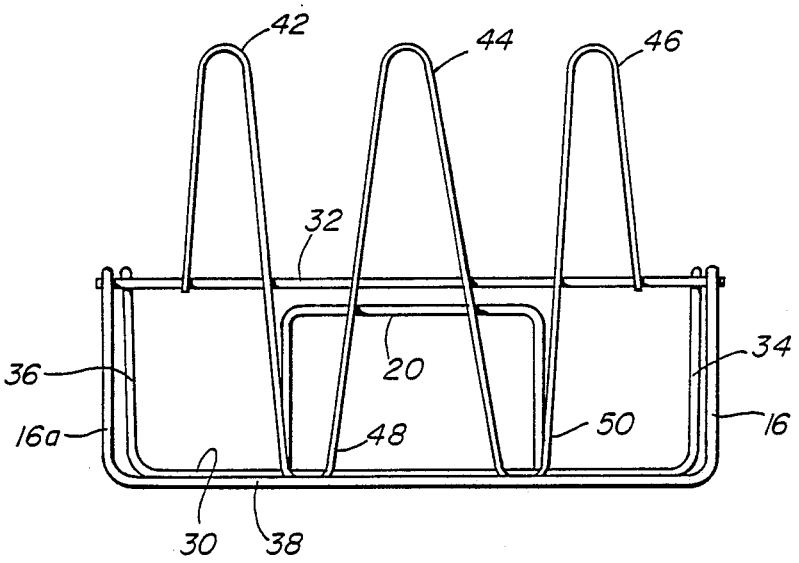
FIG. 4 is a bottom plan view of the present invention.

A preferred form of bag bottom supporting means is illustrated in greater detail in FIG. 4. FIG. 4 illustrates the snake-like configuration of the bag bottom supporting means 40. It will be appreciated, however, that other bag bottom supporting means such as a flat supporting plate could be provided in place of the snake-like configuration illustrated. In addition, in the snake-like form of bag bottom supporting means, any number of loops 42, 44, 46, 48 and 50 could be provided. Thus, it may only be necessary to provide two loops extending frontally of the structure, rather than the three loops illustrated, etc.

Another alternative for bag bottom supporting means could comprise, e.g., additional vertically extending frame members, extending downwardly from the retaining means 10 and then proximate the bottom of the structure, such vertically extending frame members could be curved rearwardly in order to provide support for the bag. If desired, such means could curve rearwardly further in order to provide support for a roll of bags at the rear of the structure.

Referring once again to FIGS. 1 and 2 of the drawings, there is illustrated, in dotted lines, a bag B which has been inserted into the support structure for use. In the FIG. 1 and 2 embodiments, bag B is a typical handle bag having a front handle H formed by punched out portion or aperture 64. The rear of the bag B also has a similar punched out portion to form a rear handle on the bag. In use of the support structure of this embodiment, a front and rear handle bag B is inserted through the retaining means 10 of the structure. The open mouth of the bag is folded over the retaining means 10 and the handles H are looped over the handle engaging means 12 and 12*a*. In this manner, the handle engaging means provide support for the bag when refused is thrown therein.

The body of the front and rear handle bag B is retrained from lateral movement throughout its length by the provision of lateral restraining means 16 and 16*a*. In addition, bag bottom supporting means 40 provide support for the bottom of the bag, while the frame member 28 comprising members 30, 32, 34 and 36 provide both bag bottom support means as well as means for restraining lateral and rearward movement of the bag. Additional support for the bottom of the bag is provided by the horizontally extending intermediate portion 20, while the rear frame members 18 and 18*a* aid in preventing rearward movement of the bag.

As will be appreciated, when the support structure is to be utilized, e.g., inside a cupboard door, whenever the door is opened and/or closed, the bag retained in the support structure would tend to swing back and forth as well as laterally, without the provision of some sort of restraining means, and thus, with the device of the present invention, such swinging motion is restrained.

With the open frame structure of the present invention, expansion of the refuse bag contained therein is possible so that the amount of refuse that the bag can contain is not limited by, e.g., any rigid walls of a support structure. Rather, the bag is free to expand to its full extent with the structure of the present invention.

In addition, with such an open frame structure, less stress and wear on the hinges of cupboard doors occurs than with a closed-in rigid support structure.

As will also be obvious, the open frame structure of the present invention is more economical in terms of manufacturing costs than prior art closed-in rigid structures.

Figure 5:
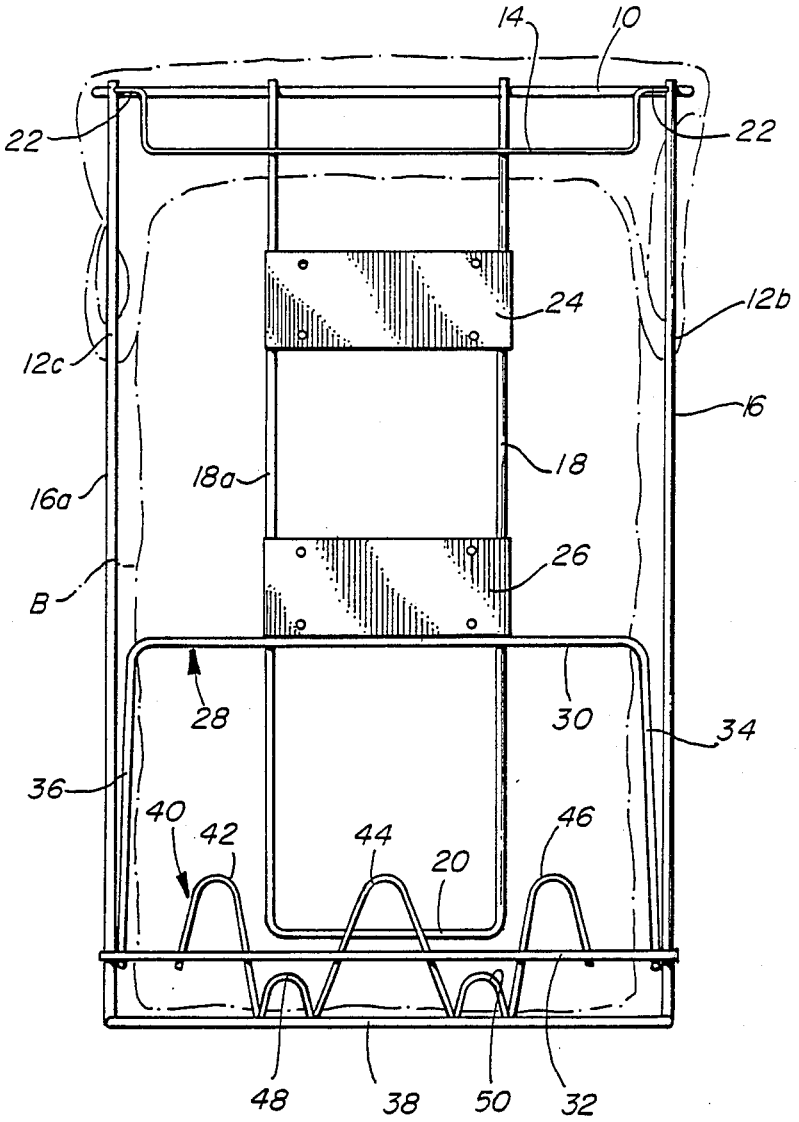
FIG. 5 is a front elevational view of another embodiment of the present invention.
Figure 6:
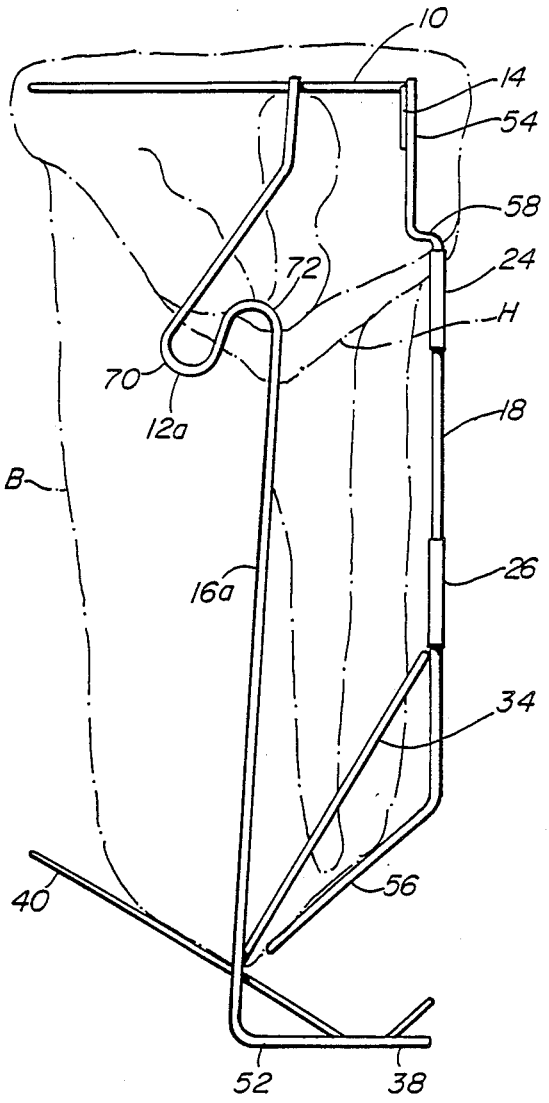
FIG. 6 is a side elevational view of the FIG. 5 embodiment.
Figure 7:
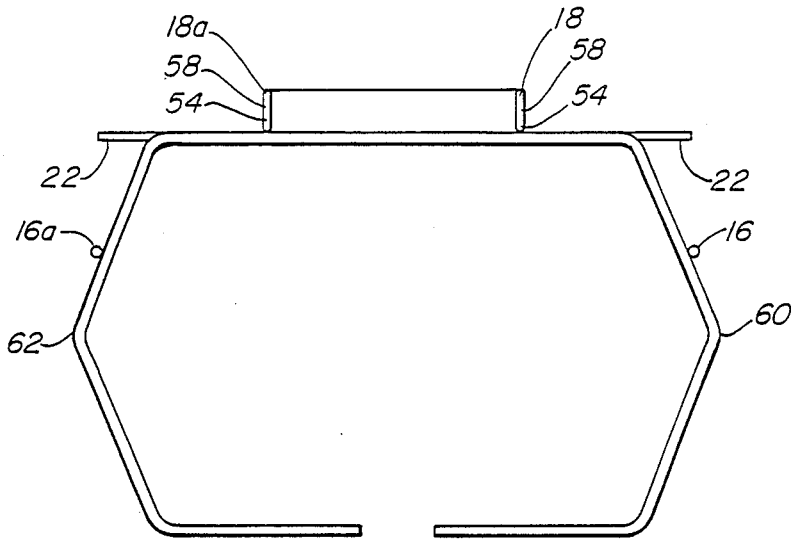
FIG. 7 is a top plan view of the FIG. 5 embodiment.

Referring now to FIGS. 5 through 7 of the drawings, an alternative arrangement of the bag engaging means is illustrated. Throughout FIGS. 5 through 7, similar reference numerals designate similar components previously described with reference to FIGS. 1 through 4.

As seen from FIGS. 5 and 6, the bag engaging means 12*b* and 12*c* are provided on the lateral restraining means 16 and 16*a*. The embodiment of FIGS. 5 through 7 is particularly adapted for use with side type handle bags where a handle is provided on each lateral side of the bag. Bag engaging means 12*b* and 12*c* are formed of loop-shaped members 70 extending frontwardly of the structure and inverted loop shaped members 72 which all form an integral part of the lateral bag restraining means 16 and 16*a*. As illustrated, the loop-shaped members 70 an.d 72 may be in the form of a S-shaped portion provided on the lateral bag restraining means.

In this particular embodiment, a side-type handle bag B is illustrated. In operation of the device of this embodiment, a bag B is inserted into the open mouth of the retaining means 10 with the side handles H of the bag B being looped over the bag engaging means 12*b* and 12*c* provided on the lateral restraining means 16 and 16*a*.

As in the case of the embodiment of FIGS. 1 through 4, the bag engaging means 12*b* and 12*c* provide support for the handles of the bag so that when refuse is placed into the bag, the bag is held in place by virtue of the bag engaging means engaging each handle H of the bag B.

Of course, it is possible that the bag engaging means 12*b* and 12*c*, although illustratively extending frontwardly of the structure, could be turned 90° or even 180° so that the bag engaging means 12*b* and 12*c* could extend laterally outwardly or even rearwardly of the structure.

It will be noted that in the embodiment shown in FIGS. 5 through 7, the ring-shaped retaining means 10 is provided with a pair of spaced-apart free ends generally centrally on the front of the structure. With such a structure, the retaining means are thereby compressible by a user so as to enable an open mouth type bag to be positioned over the retaining means, and when in place, to hold the open mouth bag tightly thereon. In the case of the FIGS. 1 through 4 embodiment, although the retaining means 10 are not provided with the spaced-apart free ends, the structure will still operate in the manner described above with regard to FIGS. 5 through 7 in view of the provision of the front U-shaped bag handle engaging means.

A further alternative for the support structure of the present invention, for both the embodiments of FIGS. 1 through 4 as well as that of FIGS. 5 through 7, is a height adjustable structure so that varying sizes of bag lengths could be utilized with the device.

Thus, for instance, the lateral bag restraining means 16 and 16*a* could be formed of a two-piece construction, where, e.g., the lower portion was formed of a hollow tube with the upper portion being slidingly insertable into the lower portion, and including a conventional type of releasable locking arrangement to releasably lock the restraining means at the appropriate height for the desired size of bag. In such a case, of course the rear frame members 18 and 18*a* would be of a similar sliding arrangement, although they need not be provided with any locking structure.

Referring once again to the drawings, it will be appreciated that although only one bag engaging means 12*b* and 12*c* have been illustrated on each lateral restraining member, two or more of such bag engaging means could be provided at different levels along the lateral restraining member so that a still further alternative for accommodating different sizes of bag lengths is provided.

It will be understood that various alterations or modifications can be made to the above-described embodiments, without departing from the spirit and scope of the invention.

I claim:

1. In a supporting structure for flexible containers comprising: retaining means for retaining the open mouth of a flexible container open under tension; means for restraining lateral movement of a container mounted in said device, said means for restraining lateral movement comprising a pair of spaced apart, opposed restraining members extending below said retaining means; flexible container bottom supporting means for supporting a bottom of said flexible container; the improvement comprising opposed flexible container handle engaging means consisting of a first loop extending upwardly towards said retaining means and spaced therefrom, and a second opposed loop connected to said first loop extending downwardly from said retaining means towards said bottom supporting means, said first and second loops forming an S-shaped hook member associated with each of said restraining members, said first loop being for engaging and retaining a handle of a flexible container and said second loop being for ready removal of said handle from said first loop.

2. A supporting structure for flexible containers as defined in claim 1, wherein said retaining means comprises a one-piece ring-shaped frame member having a pair of spaced-apart free ends capable of engaging the open mouth of an open mouth type bag.

3. A supporting structure for flexible containers as defined in claim 1, wherein said retaining means comprises a ring-shaped wire or plastic rod.

4. A supporting structure for flexible containers as defined in claim 1, wherein said restraining members extend between said retaining means and said flexible container bottom supporting means.

5. A supporting structure for flexible containers as defined in claim 4 wherein said second loop of said flexible container handle engaging means extends angularly relative to said restraining members.

6. A supporting structure for flexible containers as defined in claim 1, wherein said flexible container comprises a bag having side handles.

7. A supporting structure for flexible containers as defined in claim 1, wherein said second loop of said flexible container handle engaging means extends frontally of said supporting structure.

8. A supporting structure for flexible containers as defined in claim 1, wherein said flexible container handle engaging means extend laterally outwardly of said support structure.

9. A supporting structure for flexible containers as defined in claim 1, wherein said flexible container handle engaging means extend rearwardly of said supporting structure.

10. A supporting structure for flexible containers as defined in claim 1, wherein each restraining member is provided with more than one flexible container handle engaging means.

11. A supporting structure for flexible containers as defined in claim 1, wherein said means for restraining lateral movement of a container comprise adjustable restraining means for mounting of different bag-lengths in said structure.

* * * * *